US012618257B2

(12) United States Patent
Rossi

(10) Patent No.: US 12,618,257 B2
(45) Date of Patent: May 5, 2026

(54) COLUMBARIUM FOR CONTAINING FUNERARY OBJECTS

(71) Applicant: BIONDAN NORTH AMERICA INC., Toronto (CA)

(72) Inventor: Filippo Rossi, Isola Della Scala (IT)

(73) Assignee: BIONDAN NORTH AMERICA INC., Toronto (CA)

( * ) Notice: Subject to any disclaimer, the term of this patent is extended or adjusted under 35 U.S.C. 154(b) by 183 days.

(21) Appl. No.: 18/390,154

(22) Filed: Dec. 20, 2023

(65) Prior Publication Data

US 2024/0271455 A1 Aug. 15, 2024

(30) Foreign Application Priority Data

Feb. 13, 2023 (IT) ..... 102023000002352

(51) Int. Cl.
*E04H 13/00* (2006.01)

(52) U.S. Cl.
CPC ..... *E04H 13/006* (2013.01)

(58) Field of Classification Search
CPC ..... E04H 13/00; E04H 13/006; E04H 13/008; A61G 99/00
USPC ..... 52/134, 136, 137
See application file for complete search history.

(56) References Cited

U.S. PATENT DOCUMENTS 5,477,594 A * 12/1995 LePage ..... E04H 13/006 211/84
6,250,025 B1 * 6/2001 Darby ..... E04H 13/006 52/142
2015/0308141 A1 * 10/2015 Ugartechea Berlanga ..... E04H 13/008 52/135
2017/0183889 A1 * 6/2017 Rossi ..... E04H 13/008
2019/0368219 A1 * 12/2019 Rossi ..... E04H 13/006

FOREIGN PATENT DOCUMENTS

| | | | | |
|---|---|---|---|---|
| IT | 201900003279 A1 | | 9/2020 | |
| KR | 200313352 Y1 | | 5/2003 | |
| KR | 200320029 Y1 | | 7/2003 | |
| KR | 101351299 B1 | * | 1/2014 | ..... E04H 13/006 |
| KR | 20210067231 A | * | 6/2021 | ..... E05D 3/02 |
| KR | 102409365 B1 | * | 6/2022 | ..... E04H 13/006 |

OTHER PUBLICATIONS

Italian Search Report and Written Opinion dated Jul. 21, 2023 issued in IT 202300002352, with partial translation.

* cited by examiner

*Primary Examiner* — Christine T Cajilig
(74) *Attorney, Agent, or Firm* — Scully, Scott, Murphy & Presser, P.C.

(57) ABSTRACT

A columbarium for containing funerary objects, provided with at least one self-supporting base structure which can be arranged so as to rest on a supporting surface and forms a plurality of niches for housing funerary objects; the base structure comprises a plurality of portions of profiled elements which are mutually interconnected and are arranged along at least two mutually perpendicular directions, in order to delimit at least one portion of the niches; the portions of profiled elements each have at least one longitudinal seat for the insertion of a portion of at least one respective elongated connecting element for the mutual connection of at least two of the portions of profiled elements arranged contiguously to each other.

10 Claims, 11 Drawing Sheets

COLUMBARIUM FOR CONTAINING FUNERARY OBJECTS

The present invention relates to a columbarium for containing funerary objects.

As is known, columbaria constituted by a structure that forms a plurality of funerary niches or recesses, which are usually closed by slabs of marble or other stone-like material and inside which funerary objects, such as for example coffins, cinerary urns or funerary boxes, can be placed are installed in cemeteries.

Usually, columbaria are made of masonry or concrete and are provided in the walls of the constructions and buildings that are part of the cemetery.

Small columbaria with a self-supporting base structure, typically for housing cinerary urns, are also known and are placed in a stand-alone arrangement on floors or other supporting surfaces as part of parks or gardens or areas of another kind.

Columbaria of this type may have niches on two opposite faces of their base structure and are normally made of concrete blocks or slabs of stone-like material which are pre-assembled together, and therefore they have a considerable weight.

The installation of this type of columbarium is quite complex, since it is performed by transporting their base structure, which is already assembled, to the site of use, with the difficulties associated with the weight of the base structure.

The aim of the present invention is to provide a columbarium for containing funerary objects that is capable of improving the background art in one or more of the above aspects.

Within this aim, an object of the invention is to provide a columbarium that is easy and convenient to install.

Another object of the invention is to provide a columbarium that can be assembled at the site of use, so as to simplify its transportation.

A further object of the invention is to provide a columbarium that has a solid structure capable of validly bearing the load of marble slabs.

Another object of the present invention is to provide a columbarium that can be installed without requiring particular skills on the part of the operators.

A still further object of the present invention is to overcome the drawbacks of the background art in a manner that is alternative to any existing solutions.

Not least object of the invention is to provide a columbarium for containing funerary objects that is highly reliable, relatively easy to provide, and can be manufactured at competitive costs.

This aim, as well as these and other objects that will become better apparent hereinafter, are achieved by a columbarium for containing funerary objects according to claim 1, optionally provided with one or more of the characteristics of the dependent claims.

Further characteristics and advantages of the invention will become better apparent from the description of a preferred but not exclusive embodiment of the columbarium for containing funerary objects according to the invention, illustrated by way of non-limiting example in the accompanying drawings, wherein.

Figure 1:
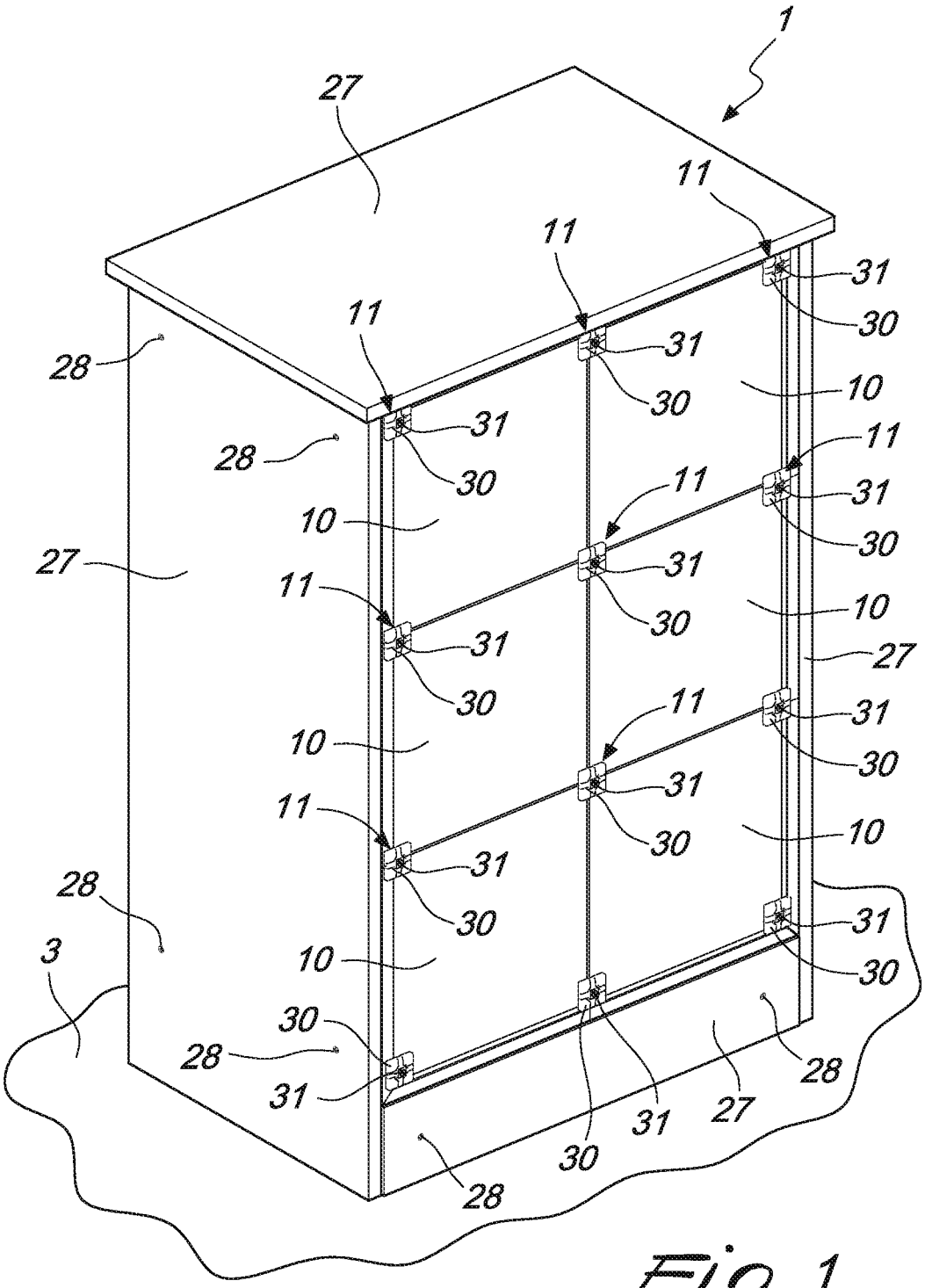
FIG. 1 is a perspective view of a columbarium according to the invention.
Figure 2:
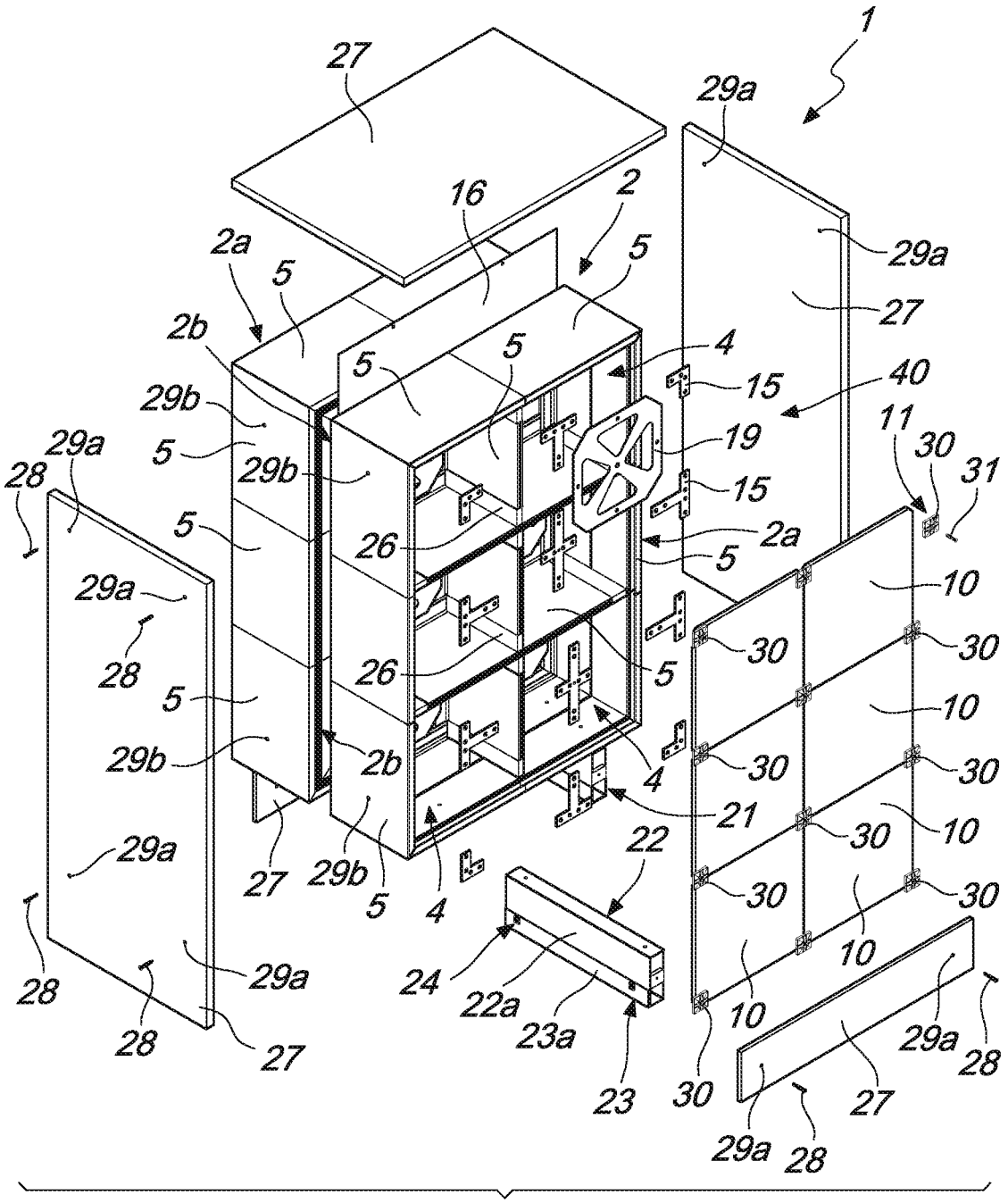
FIG. 2 is an exploded perspective view of a columbarium according to the invention.
Figure 2A:
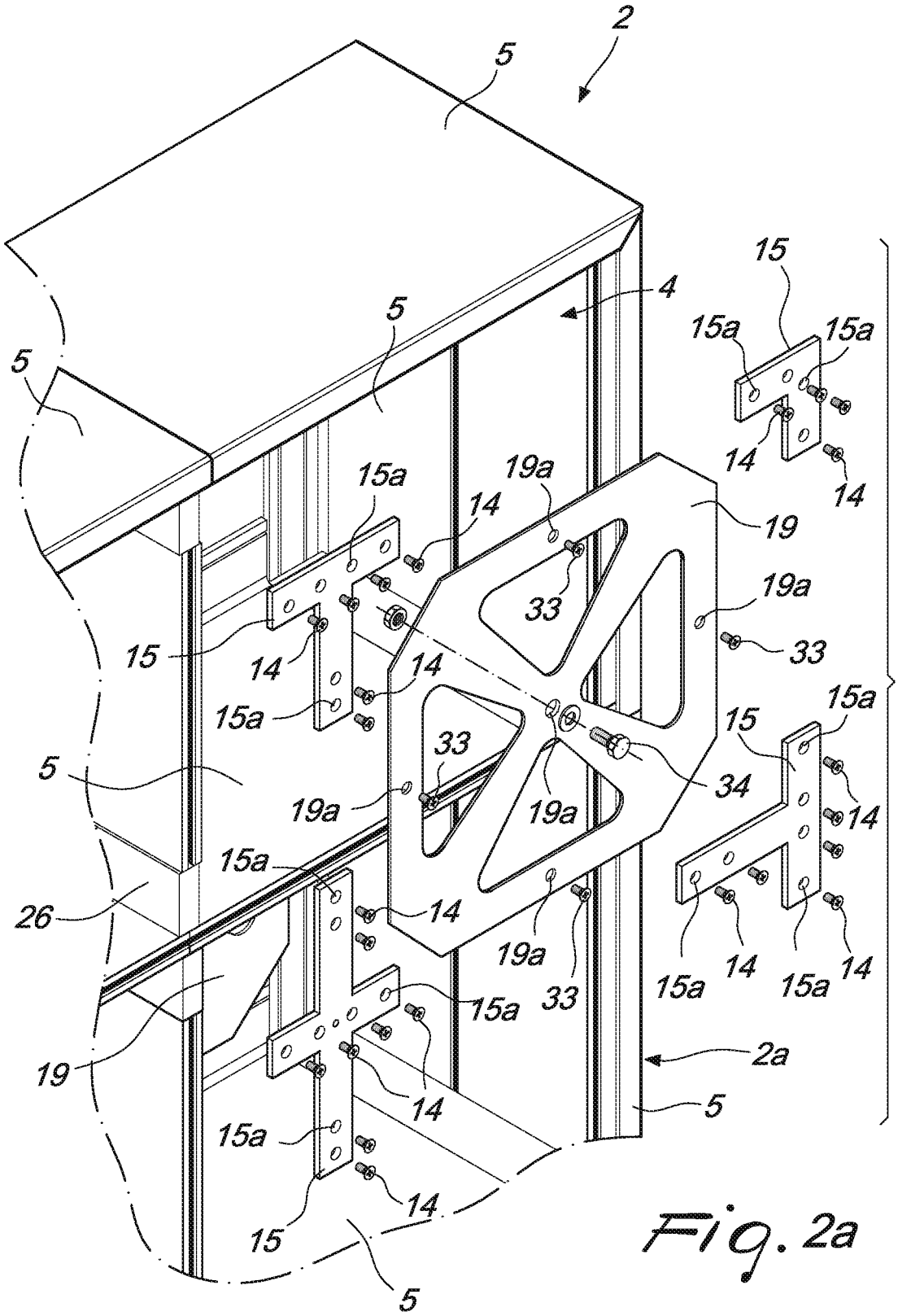
Figure 3:
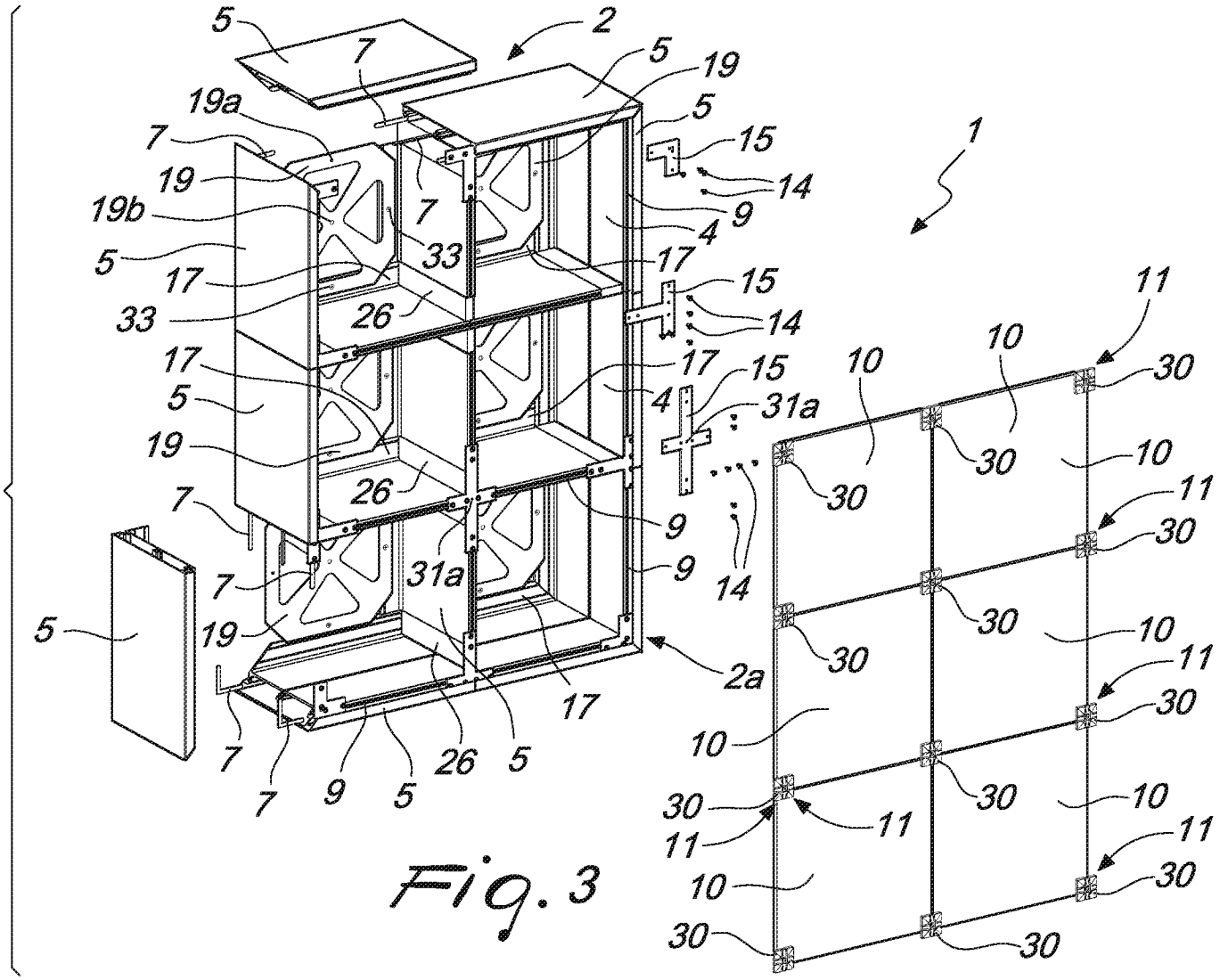
Figure 3A:
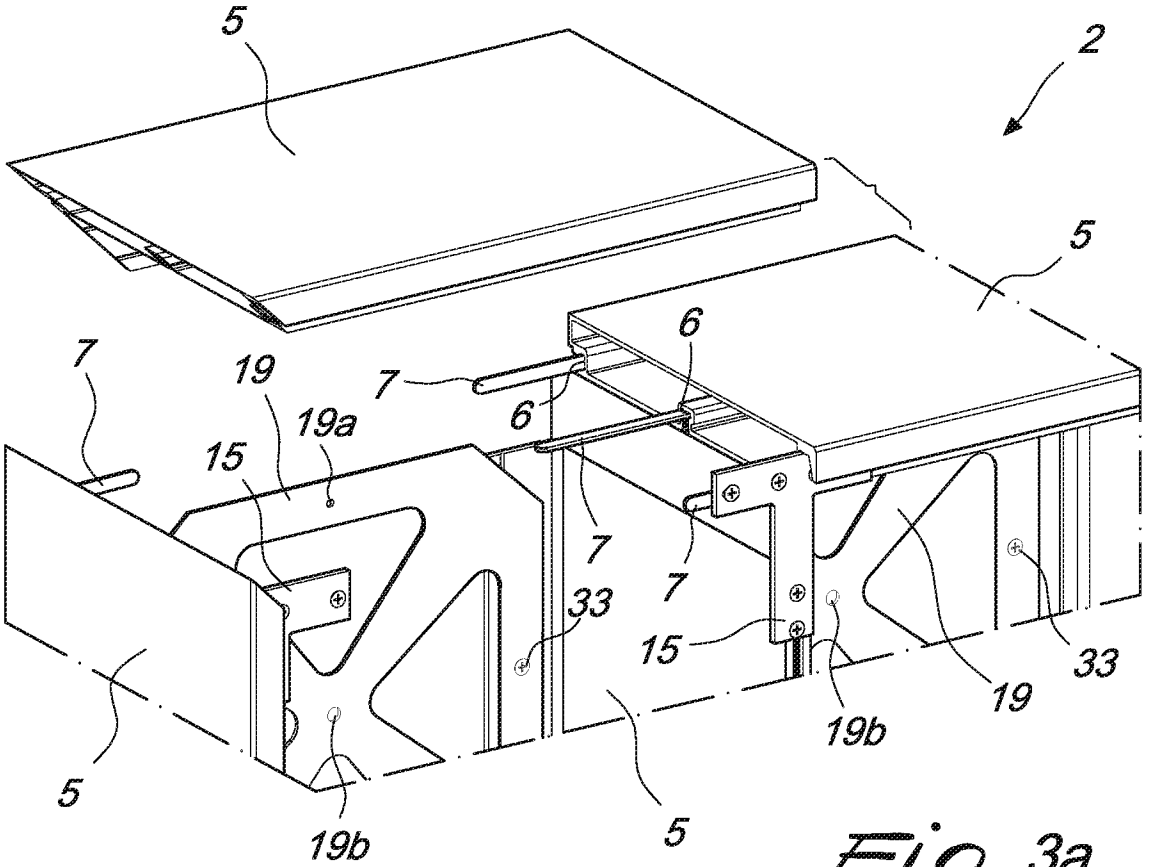
Figure 3B:
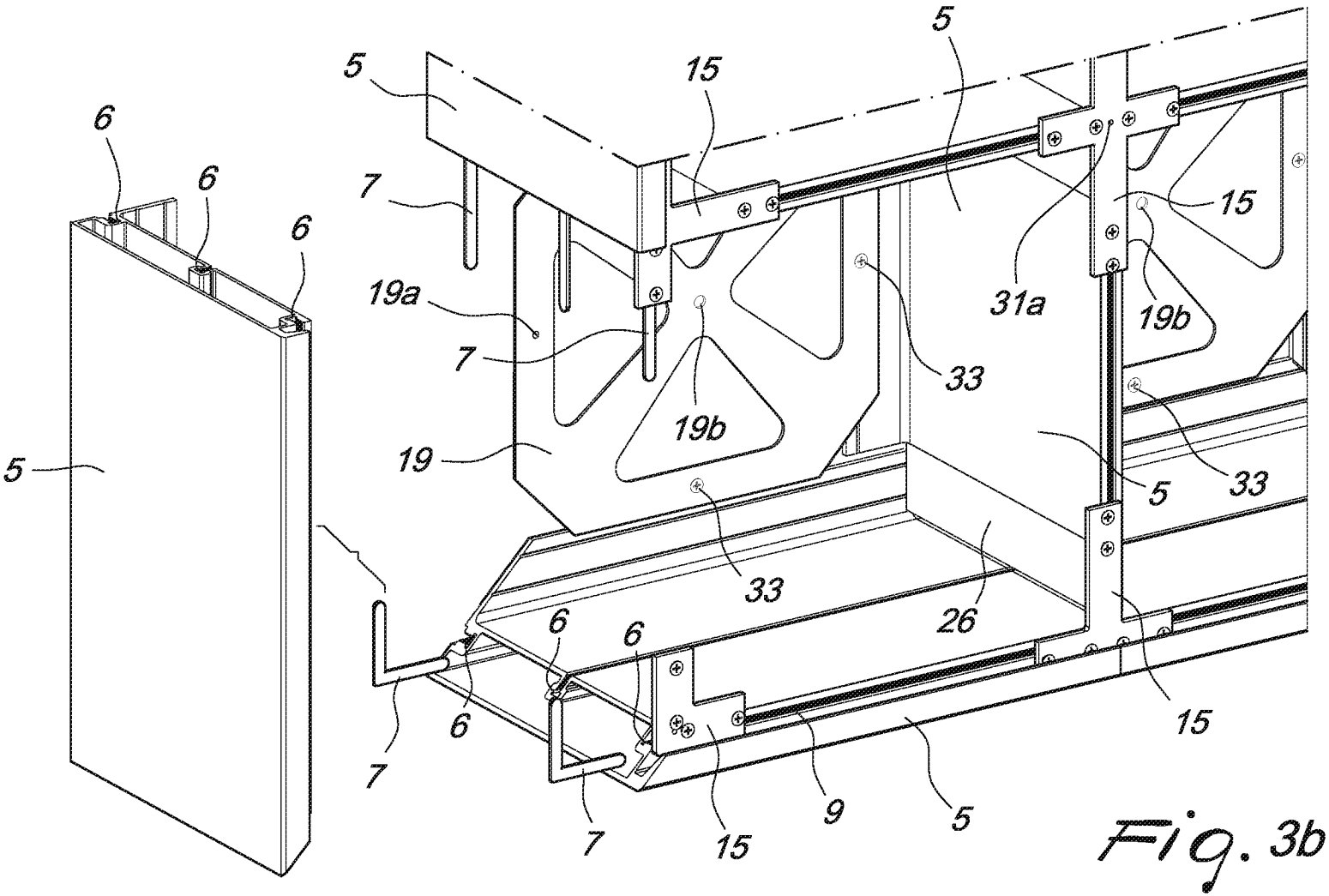
Figure 4:
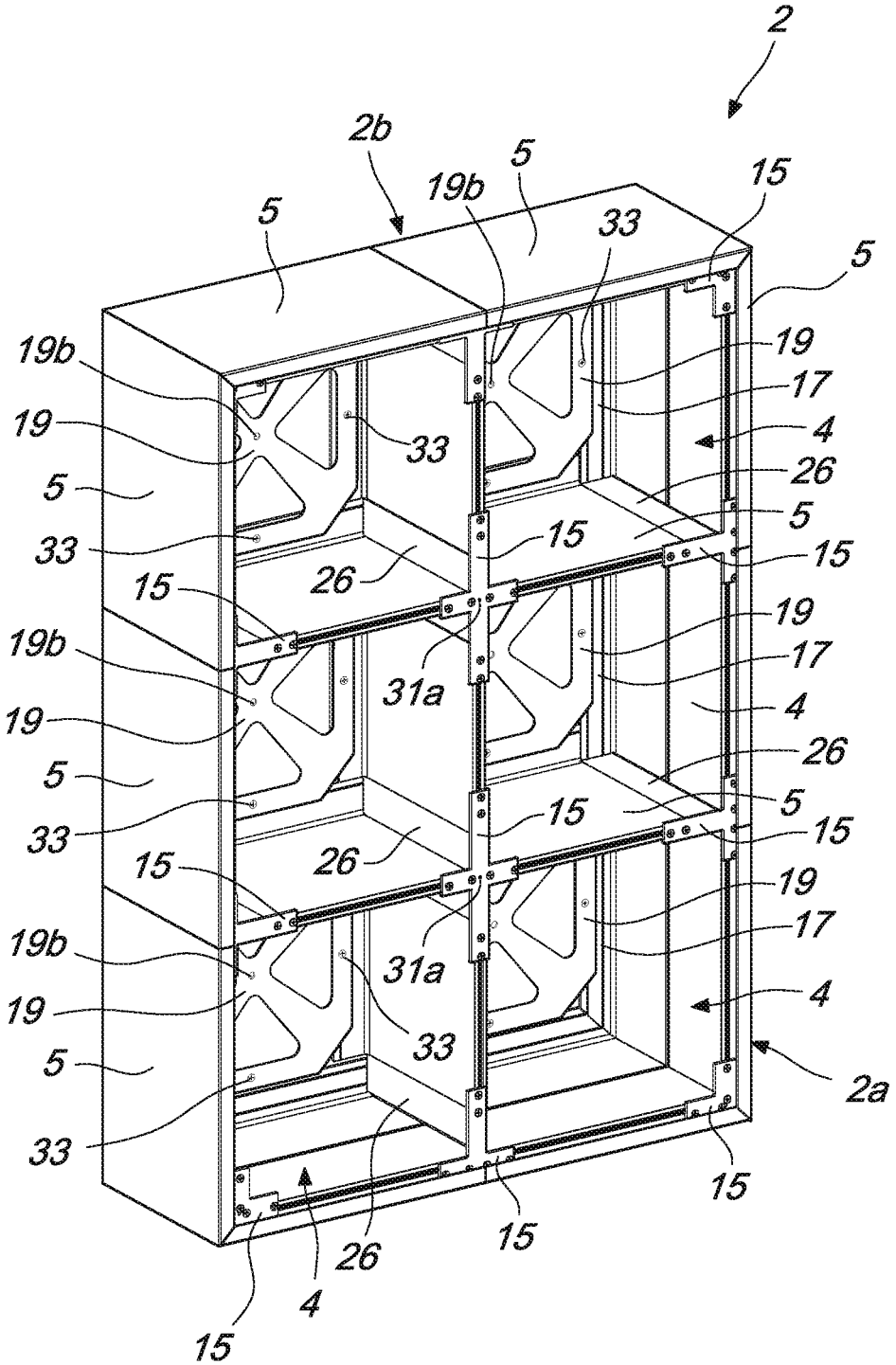
Figure 5:
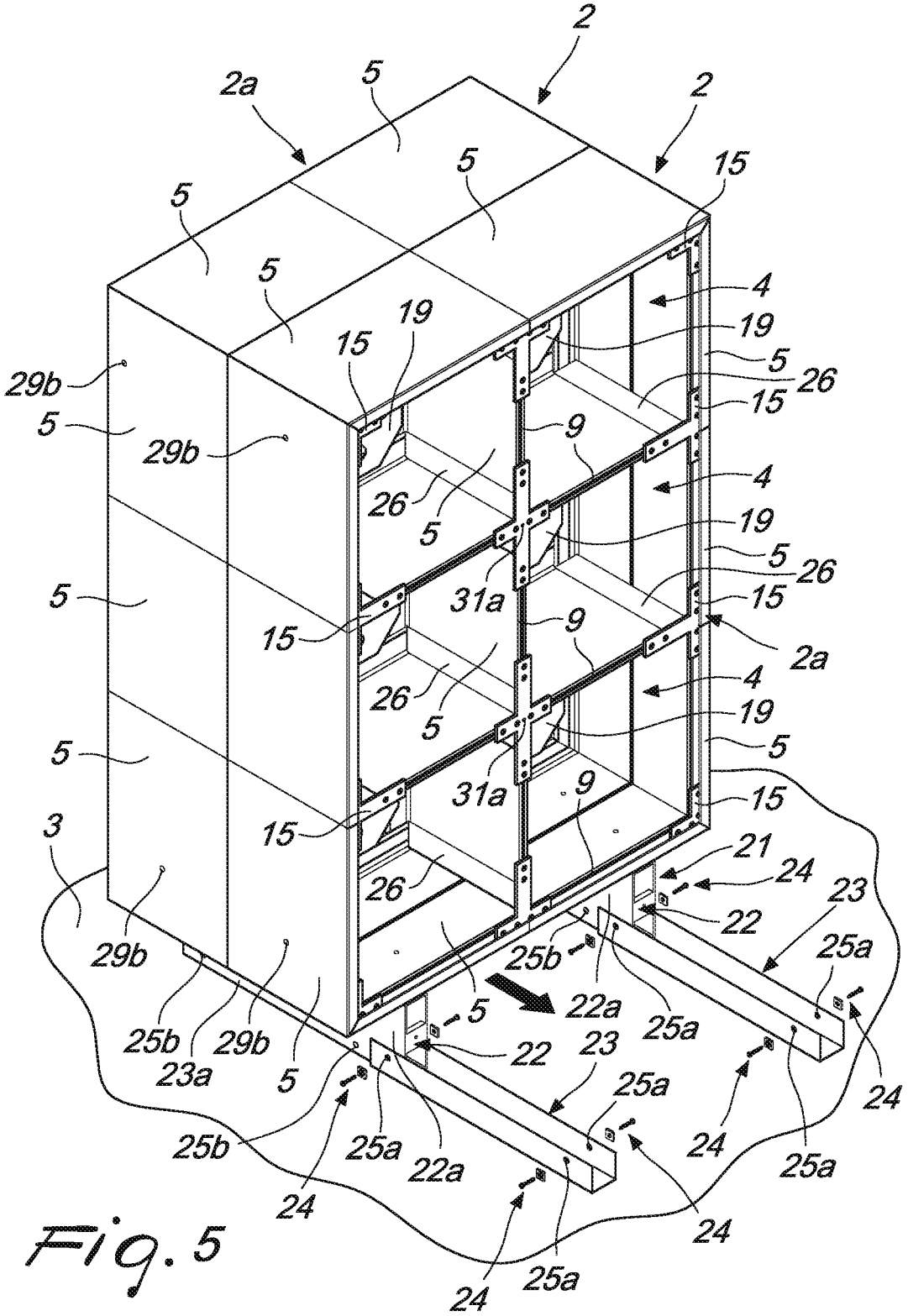
Figure 6:
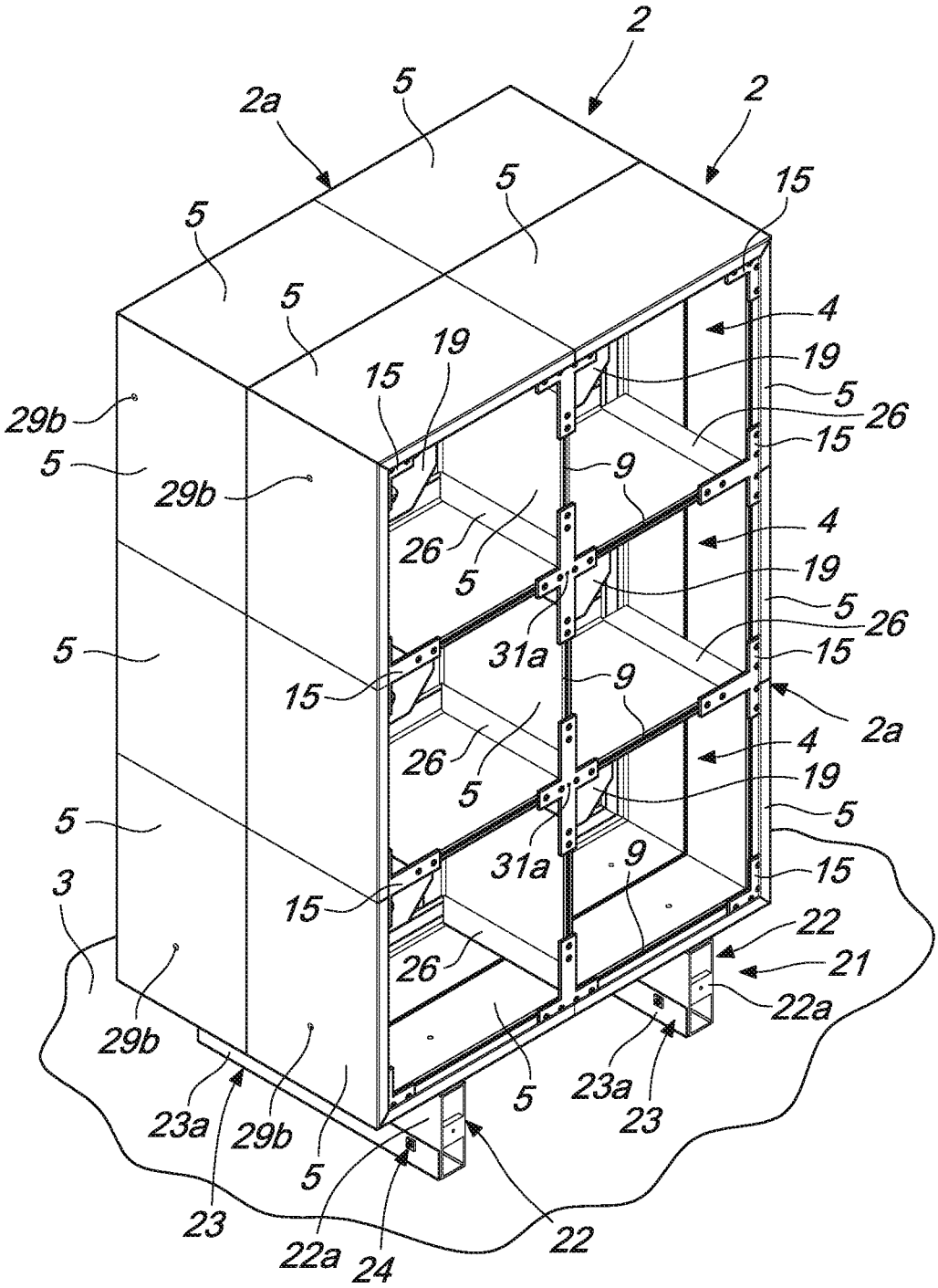
Figure 7:
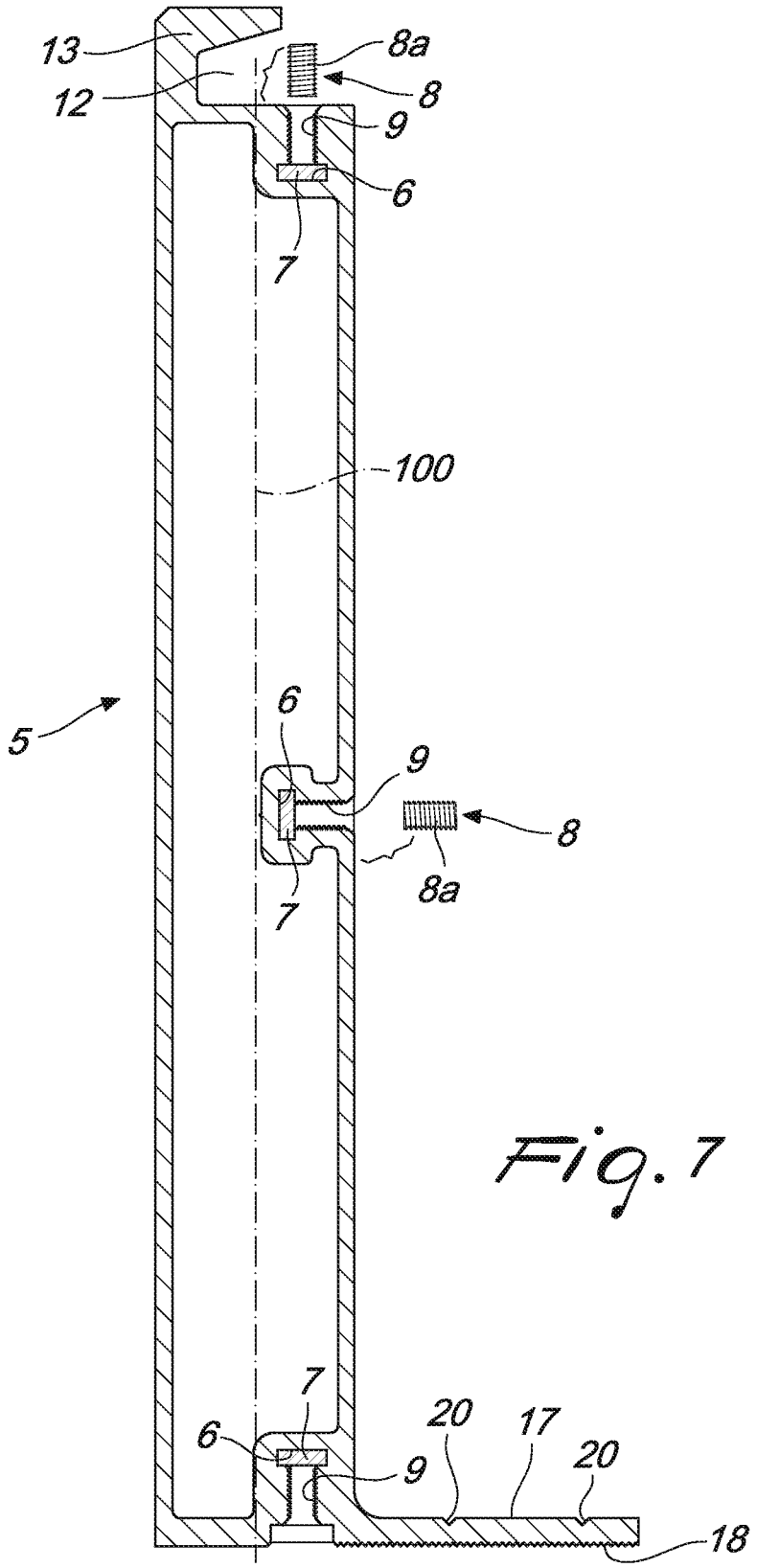
Figure 8:
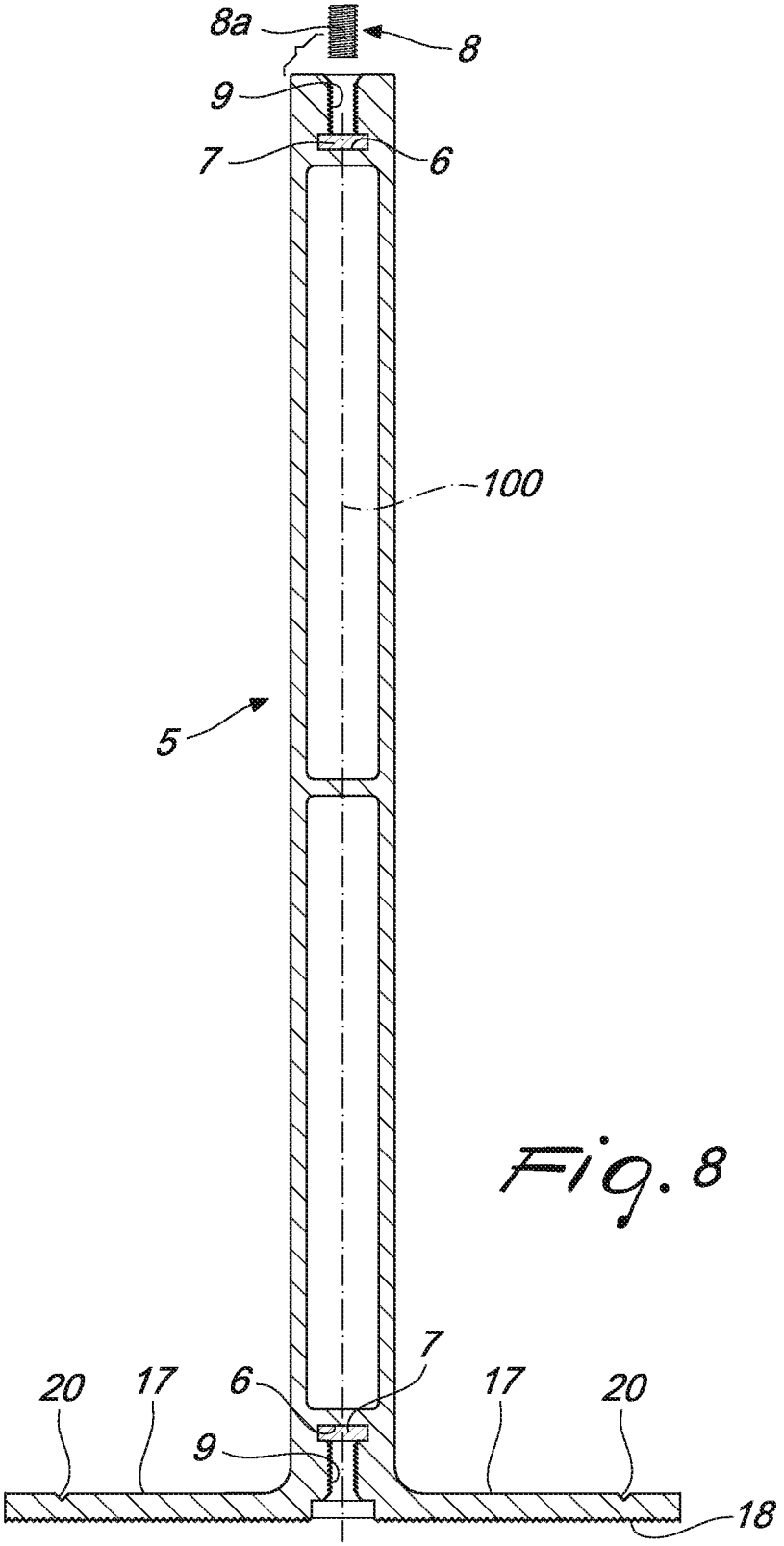

FIG. 2*a* is an enlarged-scale exploded view of a detail of the columbarium according to the invention;

FIG. 3 is an exploded perspective view of a part of a columbarium according to the invention;

FIG. 3*a* is an enlarged-scale view of a detail of FIG. 3;

FIG. 3*b* is an enlarged-scale view of another detail of FIG. 3;

FIG. 4 is a perspective view of a base structure of a columbarium according to the invention;

FIGS. 5 and 6 are sequential perspective views of steps of installation of a columbarium according to the invention;

FIGS. 7 and 8 are transverse sectional view of two types of portions of profiled elements that can be used for the provision of the base structure of a columbarium according to the invention.

With reference to the figures, the columbarium for containing funerary objects according to the invention, generally designated by the reference numeral 1, comprises at least one self-supporting base structure 2, which is adapted to be rested on a supporting surface 3, constituted for example by a floor, a concrete casting or another suitable surface.

The base structure 2 forms a plurality of niches 4, which allow to house funerary objects within them, such as for example cinerary urns, funerary boxes, photographs of the deceased, or others.

According to the invention, the basic structure 2 is provided by means of a plurality of portions of profiled elements 5, which are connected to each other and are arranged along at least two mutually perpendicular directions, so that they delimit, with at least one of their directions of extension, at least one portion of the niches 4.

In practice, the portions of profiled elements 5 form, with at least one of their portions of extension, at least one of the side walls that delimit the niches 4.

In particular, the portions of profiled elements 5 are obtained from profiled bars, conveniently made of metallic material, having a longitudinal extension with a substantially constant transverse cross-section, which are manufactured for example by extrusion, drawing, sheet metal bending, or other equivalent methods.

Conveniently, the portions of profiled elements 5 have a transverse cross-section with a shape that is elongated along a direction of extension 100 and form, with at least one of their surfaces that is opposite with respect to said direction of extension 100, at least one portion of at least one of the walls that delimit the recesses 4 of the base structure. The extension of the transverse cross-section of the portions of profiled elements 5 in the direction of extension 100 defines the extension in depth of the niches 4, i.e., their extension in the direction that is substantially perpendicular to their access opening.

Also according to the invention, each portion of profiled elements 5 has at least one longitudinal seat 6 for the insertion of a portion of at least one respective elongated connecting element 7, which allows to provide the mutual connection of at least two of said portions of profiled elements 5 arranged contiguously to each other.

Advantageously, each elongated connecting element 7 is fixed to at least one of the portions of profiled elements 5 in which it is inserted by virtue of screw-type locking means 8.

Conveniently, each elongated connecting element 7 is provided by a rod or bar, preferably having a flattened section.

The elongated connecting elements 7 may have a substantially rectilinear extension, if they are used to join portions of profiled elements 5 which are arranged in alignment with each other, or an angular or L-shaped extension, with two arms arranged substantially at right angles to each other, to allow the joining of portions of profiled elements arranged at an angle to each other.

In greater detail, each portion of profiled element 5 has a plurality of longitudinal seats 6.

Preferably, there are at least two longitudinal seats 6 positioned at two opposite regions of the transverse cross-section of the portions of profiled elements 5, for example the two opposite regions located along the direction of extension 100 of the transverse cross-section of the portions of profiled elements 5, and optionally at least one longitudinal seat 6 located in a region that is intermediate between the two opposite regions where the other longitudinal seats 6 are located.

Preferably, each longitudinal seat 6 is formed within the portions of profiled elements 5. More particularly, each longitudinal seat 6 is located within the perimetric space occupation of the transverse cross-section of the portions of profiled elements 5, so that the elongated connecting elements 7 can operate in regions located within the transverse cross-section of the portions of profiled elements 5.

Each longitudinal seat 6 conveniently communicates with at least one respective longitudinal engagement groove 9 which is accessible from the outside of the portions of profiled elements 5.

In particular, each of the longitudinal engagement grooves 9 advantageously has mutually opposite threaded walls for the engagement of said screw-type locking means 8, which may conveniently be provided by threaded grub screws 8*a* which can be screwed into the longitudinal engagement grooves 9 to lock the elongated connecting elements 7 inserted in the corresponding longitudinal seats 6.

Conveniently, at least one closure plate 10 is provided which allows to close the niches 4 formed in the base structure 2 at the corresponding access opening. Preferably, one closure plate 10 is provided for each niche 4.

Each closure plate 10 can be fixed, by virtue of fixing means 11, to at least one face of the base structure 2 and, more particularly, at least to the outer or front face 2*a* of the base structure 2 at which the access opening of the niches 4 is formed.

Advantageously, at least the portions of profiled elements 5 that are arranged along the lateral perimeter of the base structure 2 have, on their side arranged at the outer face 2*a* of the base structure 2, at least one accommodation groove 12 for at least one peripheral portion of the closure plates 10.

The accommodation groove 12 is conveniently delimited by a retention tooth 13 that engages the face of the closure plates 10 that is opposite with respect to the base structure 2.

Conveniently, at least one of the longitudinal engagement grooves 9 provided in the portions of profiled elements 5 is accessible from the outer face 2*a* of the base structure 2 to allow the accommodation of fixing screws 14, which allow to anchor at least one body 15 for connection between portions of profiled elements 5 that are mutually contiguous to the outer face 2*a* of the base structure 2.

Advantageously, the or each connecting body 15 comprises a respective crosspiece or connection bracket, constituted for example by a respective plate having two or more fixing regions for its connection to respective portions of profiled elements 5 to be joined together. In particular, the connecting bodies 15 may be, in plan view, L-shaped, T-shaped or cross-shaped, depending on the number of portions of profiled elements 5 that they allow to join together.

Advantageously, the connecting bodies 15 are provided with fixing holes 15*a* which can be engaged by the fixing screws 14.

According to a preferred embodiment, the columbarium according to the invention comprises at least one pair of base structures 2 which are mutually opposite and face each other with one of their inner or rear faces 2*b*, directed oppositely with respect to the corresponding outer face 2*a*.

The two base 2 structures are conveniently joined together at their rear face 2*b*, as will be better explained hereinafter.

Advantageously, the portions of profiled elements 5 have, on their side or edge designed to face oppositely with respect to the outer face of the corresponding base structure 2, at least one longitudinal wing 17, which protrudes substantially parallel to the outer face 2*a* of the corresponding base structure 2.

In particular, the portions of profiled elements 5 designed to provide the perimeter of the corresponding base structure 2, shown in FIG. 7, have a single longitudinal wing 17 designed to be arranged within the perimeter of the base structure 2, while the other portions of profiled elements 5, shown in FIG. 8, may have two longitudinal wing 17 which are mutually opposite.

In particular, the longitudinal wing or wings 17 protrude substantially at right angles from the surfaces of the portions of profiled elements 5 designed to form the walls that delimit the niches 4.

Advantageously, connecting means 40 are provided for the mutual connection of the base structures 2 that compose the columbarium and will be described hereinafter.

Optionally, but not necessarily, a partition panel 16 may be interposed between the base structures 2.

Conveniently, on their surface designed to be directed oppositely to the outer face 2*a* of the corresponding base structure 2, the longitudinal wings 17 may have knurled regions 18 that allow to increase their grip on the connecting panel 16.

The base structures 2 are advantageously also provided with closure plates 19, which are fixed to the longitudinal wings 17 of the portions of profiled elements 5 and are configured to close at least some of said recesses 4 and, more preferably, all of the recesses 4, on their side directed toward the inner face 2*b* of the corresponding base structure 2.

The closure plates 19 also have the function of joining together various portions of profiled elements 5, in particular those that delimit the corresponding niche 4.

The closure plates 19 are fixed to the longitudinal wings 17 that protrude toward the inside of the respective niche 4 by means of screws 33, which are conveniently inserted in fixing holes 19*a* advantageously formed in the peripheral region of the closure plates 19.

Advantageously, the connecting means 40 conveniently act at the closure plates 19 of the two base structures 2 and advantageously comprise bolts 34, which allow mutual connection between the closure plates 19 of the two base structures 2 and are inserted through connection holes 19*b* formed in the closure plates 19, preferably at their central region.

In particular, if the partition panel 16 is present, the bolts 34 are also inserted through through holes, not shown, provided in the partition panel 16.

Conveniently, on the surface of the longitudinal wings 17 that is designed to be directed toward the outer face 2*a* of the corresponding base structure 2 it is possible to provide one or more abutment slots 20 for the provision of passage holes for the screws that allow the fixing of the closure plates 19 and the connection of the portions of the profiled elements to the connection panel 16.

Conveniently, the columbarium can be provided with at least one device 21 for positioning the base structure or structures on the supporting surface 3.

Advantageously, said positioning device 21 comprises at least one supporting element 22, which is fixed to the lower part of the base structure or structures 2, and at least one guiding element 23, which can be anchored to the supporting surface 3 and can be slidingly engaged by the supporting element 22.

Preferably, there are at least two supporting elements 22 arranged so as to be spaced apart along a direction that is substantially parallel to the outer face 2*a* of the base structure or structure 2 and at least two corresponding guiding elements 23.

Conveniently, each supporting element 22 is constituted by a supporting foot or pad 22*a* which protrudes downward from the lower part of the base structure or structures 2.

Each supporting pad 22*a* is advantageously provided with an elongated body having a closed polygonal cross-section, constituted for example by a profiled bar, and is extended along a direction that is substantially perpendicular to the outer face 2*a* of the base structure or structures 2.

Each guiding element 23 is constituted, in turn, by a profile 23*a* having a C-shaped transverse cross-section, with the open side of the C directed upward and configured to accommodate a corresponding support pad 22*a*.

In particular, the supporting pads 22*a* can be slidingly inserted into the profiles 23*a* through one end of said profiles.

Moreover, locking means 24 are provided which allow the mutual locking of the supporting elements 22 to the guiding elements 23.

In particular, the locking means 24 allow to lock the supporting pads 22*a* to the profiles 23*a* once the insertion of the supporting pads 22*a* in the profiles 23*a* has been performed.

For example, the locking means 24 are constituted by fixing bolts 24*a* which can be inserted through a first locking opening 25*a*, formed in the profiles 23*a*, and a second locking opening 25*b*, formed in the supporting pads 22*a* and designed to collimate with the first locking opening 25*a*, after completing the insertion of the supporting pads 22*a* in the profiles 23*a*.

To fill any gaps that may be present between mutually contiguous portions of profiled elements 5, blending elements 26 are provided which are made of an elastically deformable material, such as rubber or the like, and can be coupled, with one of their portions, in the inner cavity of the portions of profiled element 5.

Cladding slabs 27 are conveniently applied on the outer surface of the base structure or structures 2 and are made for example of stone-like material or the like, are fixed to the base structures 2 by virtue of threaded elements 28, which are inserted through through holes 29*a* provided in the cladding slabs 27 and are screwed into threaded holes 29*b* provided, for example, in the portions of profiled elements 5 arranged along the perimeter of the base structures 2 and in the supporting pads 22*a*.

It should be noted that the means 11 for fixing the closure plates 10 may conveniently comprise locking washers 30 that engage the face of the closure plates 10 that is opposite to the one directed toward the base structure 2 and are connected to the base structure 2, for example by means of respective screw elements 31, which may be screwed either into threaded holes 31*a* formed on the connecting bodies 15 or into the longitudinal engagement grooves 9 of the portions of plate-like elements 5.

The use of the columbarium, according to the invention, is as follows.

The base structure 2 is assembled by mutually connecting the portions of profiled elements 5.

To mutually connect the portions of profiled elements 5, corresponding connecting elements 7 are inserted into the longitudinal seats 6 of two contiguous portions of profiled elements 5 and are fixed to the two portions of profiled elements 5 by means of the threaded grub screws 8*a* that are screwed into the longitudinal engagement grooves 9.

Optionally, a second base structure 2 is also assembled and is made to face, with its inner face 2*b*, the inner face 2*b* of the first base structure 2, and the two base structures 2 are then connected to each other by virtue of the connecting means 40 and in particular by means of the insertion of bolts 34 through the fixing holes 19*b* of corresponding closure plates 19 in the two base structures 2.

The guiding elements 23 are anchored to the supporting surface 3 and the supporting elements 22 are fixed to the base structures 2.

With the base structures 2 resting against the supporting surface 3 by means of the supporting elements 22, one proceeds to position the base structures 2 by sliding the supporting elements 22 along the guiding elements 23.

Once the positioning of the base structures 2 is finished, the supporting elements 22 are locked to the guiding elements 23 by virtue of the locking means 24.

The cladding slabs 27 are applied to the outer surface of the base structures 2, and the recesses 4 of the two base structures 2 are closed at the respective outer faces 2*a* by mounting the closure plates 10 by virtue of the fixing means 11.

In practice it has been found that the invention achieves the intended aim and objects by providing a columbarium provided with a self-supporting base structure that can be rested on a supporting surface and is easy and practical to install.

It should be noted that the connection of the portions of profiled elements 5 that form the basic structure or structures 2 of the columbarium according to the invention by means of connecting elements 7 inserted in the longitudinal seats 6 formed in the portions of profiled elements 5 imparts the appropriate stability and the characteristic of being self-supporting to the base structures 2 of the columbarium.

The invention thus conceived is susceptible of numerous modifications and variations, all of which are within the scope of the appended claims; all the details may furthermore be replaced with other technically equivalent elements.

In practice, the materials used, so long as they are compatible with the specific use, as well as the contingent shapes and dimensions, may be any according to the requirements and the state of the art.

The disclosures in Italian Patent Application No. 102023000002352 from which this application claims priority are incorporated herein by reference.

What is claimed is:

1. A columbarium for containing funerary objects, provided with at least one self-supporting base structure which is configured to be arranged so as to rest on a supporting surface and forms a plurality of niches, for housing funerary objects, wherein said at least one base structure comprises a plurality of portions of profiled elements which are mutually interconnected and are arranged along at least two mutually perpendicular directions, in order to delimit at least one portion of said niches, said portions of profiled elements each having at least one longitudinal seat for insertion of a portion of at least one respective elongated connecting element configured for a mutual connection of at least two of said portions of profiled elements arranged contiguously to each other wherein said at least one longitudinal seat communicates with at least one respective longitudinal engagement groove which is accessible from the outside, said longitudinal engagement groove being provided with mutually opposite walls which are threaded for an engagement of said screw-type locking means and wherein said at least one elongated connecting element is fixed to at least one of the portions of profiled elements in which said elongated connecting element is inserted by virtue of screw-type locking means.

2. The columbarium according to claim 1, wherein said at least one longitudinal seat is formed inside said portions of profiled elements.

3. The columbarium according to claim 1, further comprising at least one plate for closing said niches which can be fixed, by virtue of fixing means, to at least one outer face of said base structure.

4. The columbarium according to claim 3, wherein at least the portions of profiled elements arranged along a lateral perimeter of said base structure have, on side thereof arranged at said outer face of said base structure, at least one accommodation groove for at least one peripheral portion of at least one closure plate.

5. The columbarium according to claim 3, wherein said portions of profiled elements have at least one said longitudinal engagement groove which can be accessed from said outer face of said base structure for the accommodation of fixing screws for the anchoring to said outer face of said base structure of at least one body for connection between portions of profiled elements which are mutually contiguous.

6. The columbarium according to claim 3, further comprising at least one pair of base structures positioned to face each other wherein the rear face of a base structure is directed opposite to the corresponding rear face.

7. The columbarium according to claim 3, wherein said portions of profiled elements have, on a side thereof directed oppositely to said outer face, at least one longitudinal wing, which protrudes substantially parallel to said outer face.

8. The columbarium according to claim 6, further comprising connecting means for a mutual connection of said at least one pair of base structures.

9. The columbarium according to claim 8, further comprising closure plates, fixed to longitudinal wings of said portions of profiled elements and configured to close at least some of said niches on a side thereof directed toward the face of the corresponding base structure that is opposite with respect to said outer face.

10. The columbarium according to claim 9, wherein said connecting means act at said closure plates.

* * * * *